US012404618B2

(12) United States Patent
Altintas et al.

(10) Patent No.: US 12,404,618 B2
(45) Date of Patent: Sep. 2, 2025

(54) COMBINATION WASHING AND DRYING LAUNDRY APPLIANCE HAVING A FILTER CLEANING SYSTEM FOR REMOVING LINT DURING A LAUNDRY CYCLE

(71) Applicant: WHIRLPOOL CORPORATION, Benton Harbor, MI (US)

(72) Inventors: Nilsu Altintas, Fabriano (IT); Marco Angelini, Folignano (IT); Mauro Mancini, Fabriano (IT); Simone Pistola, Esanatoglia (IT); Luca Sorana, Gualdo Tadino (IT); Stefano Turchi, Falconara Marittima (IT); Paolo Volpolini, Sigillo (IT)

(73) Assignee: Whirlpool Corporation, Benton Harbor, MI (US)

( * ) Notice: Subject to any disclaimer, the term of this patent is extended or adjusted under 35 U.S.C. 154(b) by 487 days.

(21) Appl. No.: 17/852,651

(22) Filed: Jun. 29, 2022

(65) Prior Publication Data

US 2024/0003071 A1 Jan. 4, 2024

(51) Int. Cl.

| | |
|---|---|
| ***D06F 33/69*** | (2020.01) |
| ***D06F 58/22*** | (2006.01) |
| *D06F 25/00* | (2006.01) |
| *D06F 33/63* | (2020.01) |
| *D06F 33/74* | (2020.01) |
| *D06F 105/52* | (2020.01) |
| *D06F 105/54* | (2020.01) |

(52) U.S. Cl.

CPC ..... *D06F 33/69* (2020.02); *D06F 58/22* (2013.01); *D06F 25/00* (2013.01); *D06F 33/63* (2020.02); *D06F 33/74* (2020.02); *D06F 2105/52* (2020.02); *D06F 2105/54* (2020.02)

(58) Field of Classification Search

CPC ..... D06F 33/69; D06F 58/22

See application file for complete search history.

(56) References Cited

U.S. PATENT DOCUMENTS 2,959,044 A 11/1960 Stone
3,006,176 A 10/1961 Behrens
(Continued)

FOREIGN PATENT DOCUMENTS

EP 2669417 A1 12/2013
EP 3825452 A1 5/2021
(Continued)

*Primary Examiner* — Michael E Barr
*Assistant Examiner* — Kevin G Lee
(74) *Attorney, Agent, or Firm* — Price Heneveld LLP

(57) ABSTRACT

A washing and drying appliance includes a tub having an air outlet. A drum rotationally operates within the tub. An air handling system draws process air from inside the tub and through a lint filter disposed within the air outlet that filters particulate from the process air. During a filter cleaning phase, a fluid delivery system delivers impulse amounts of wash fluid toward a sump of the tub. The impulse amounts of wash fluid are maintained between an outer surface of the drum and an inside surface of the tub. The drum operates to direct the wash fluid around the drum and along the inside surface of the tub and over an interior surface of the lint filter to remove particulate from the lint filter. A fluid pump is coupled with the sump to direct wash fluid and particulate to an external outlet.

20 Claims, 12 Drawing Sheets

(56) References Cited

U.S. PATENT DOCUMENTS

| | | | | |
|---|---|---|---|---|
| 3,022,654 | A | 2/1962 | Aberle | |
| 9,194,073 | B2 | 11/2015 | Kwon et al. | |
| 9,828,715 | B2 | 11/2017 | Kwon et al. | |
| 11,085,144 | B2 | 8/2021 | Kang et al. | |
| 2011/0271550 | A1* | 11/2011 | Kim | D06F 58/22 34/480 |
| 2020/0071873 | A1* | 3/2020 | Kang | D06F 58/30 |
| 2021/0156067 | A1 | 5/2021 | Rios Acebal et al. | |

FOREIGN PATENT DOCUMENTS

| | | | |
|---|---|---|---|
| WO | 2011054761 | | 3/2011 |
| WO | 2018164548 | A1 | 9/2018 |

* cited by examiner

A Method 700 for Cleaning a Lint Filter of a Combination Washing and Drying Appliance during Performance of a Drying Cycle and with Articles Present Within the Drum

COMBINATION WASHING AND DRYING LAUNDRY APPLIANCE HAVING A FILTER CLEANING SYSTEM FOR REMOVING LINT DURING A LAUNDRY CYCLE

BACKGROUND OF THE DISCLOSURE

The present disclosure generally relates to laundry appliances, and more specifically, to a combination washing and drying appliance having a filter cleaning system that can be used to remove particulate from a lint filter while articles to be dried are contained within a rotating drum. Combination washing and drying appliances include both washing and drying capabilities such that a fluid delivery system and an airflow path are each included within the appliance for providing these washing and drying functions within a single appliance.

SUMMARY OF THE DISCLOSURE

According to one aspect of the present disclosure, a combination washing and drying appliance includes a tub having a wall and positioned within an outer cabinet. The tub includes an air outlet through an upper portion of the wall. A drum rotationally operates within the tub. An air handling system is attached to the wall of the tub and that draws process air from inside the tub and through the air outlet to an airflow path. A lint filter is disposed within the air outlet and that filters particulate from the process air entering the airflow path. A fluid delivery system includes a valve that operates to deliver wash fluid into the inside of the tub. A sump is defined within a lower portion of the tub and below the drum. The sump includes a drain that moves wash fluid from the inside of the tub to an external outlet. During a filter cleaning phase of the appliance, the fluid delivery system delivers impulse amounts of the wash fluid to deliver the wash fluid to the sump and to maintain the wash fluid between an outer surface of the drum and an inside surface of the tub. The drum operates to direct the wash fluid in the sump around the drum and along the inside surface of the tub and over an interior surface of the lint filter to remove particulate from the lint filter. A fluid pump coupled with the sump directs the wash fluid and the particulate to the external outlet.

According to another aspect of the present disclosure, a method for operating a combination washing and drying appliance includes completing a first drying cycle with articles present within a rotating drum. A second drying cycle is selected immediately after the first drying cycle. The articles are distributed along an inner surface of the rotating drum by rotating the rotating drum at a first speed. Wash fluid is added to a tub that surrounds the rotating drum by adding impulse amounts of wash fluid that travel along an inside surface of the tub by surface adhesion. The wash fluid is circulated as circulated fluid along the inside surface of the tub using air ventilation produced by the rotating drum rotating at a second speed that is faster than the first speed. Particulate is removed from a lint filter using the circulated fluid. The circulated fluid and the particulate are collected within the sump by decelerating the rotating drum to a third speed to allow wash fluid and the particulate to fall under force of gravity into the sump of the tub, the third speed being slower than the second speed. The wash fluid and the particulate are drained from the sump by activating a fluid pump attached to the sump. The second drying cycle is activated.

According to yet another aspect of the present disclosure, a method for cleaning a lint filter located within a tub of a combination washing and drying appliance during performance of a drying phase of a laundry cycle where articles are located within a perforated drum that rotates within the tub includes steps of sensing a blockage in the lint filter, initiating an interruption in the drying phase, distributing the articles along an inner surface of the perforated drum by rotating the perforated drum at a first speed, adding wash fluid to the tub, circulating the wash fluid as circulated fluid along an inside surface of the tub by rotating the perforated drum at a second speed that is faster than the first speed, washing the lint filter using the circulated fluid to remove particulate from a surface of the lint filter, collecting the circulated fluid and the particulate within a lower portion of the tub by decelerating the perforated drum to allow the circulated fluid and the particulate to fall according to force of gravity and draining a sump to deliver the wash fluid and particulate to an external drain.

These and other features, advantages, and objects of the present disclosure will be further understood and appreciated by those skilled in the art by reference to the following specification, claims, and appended drawings.

Figure 1:
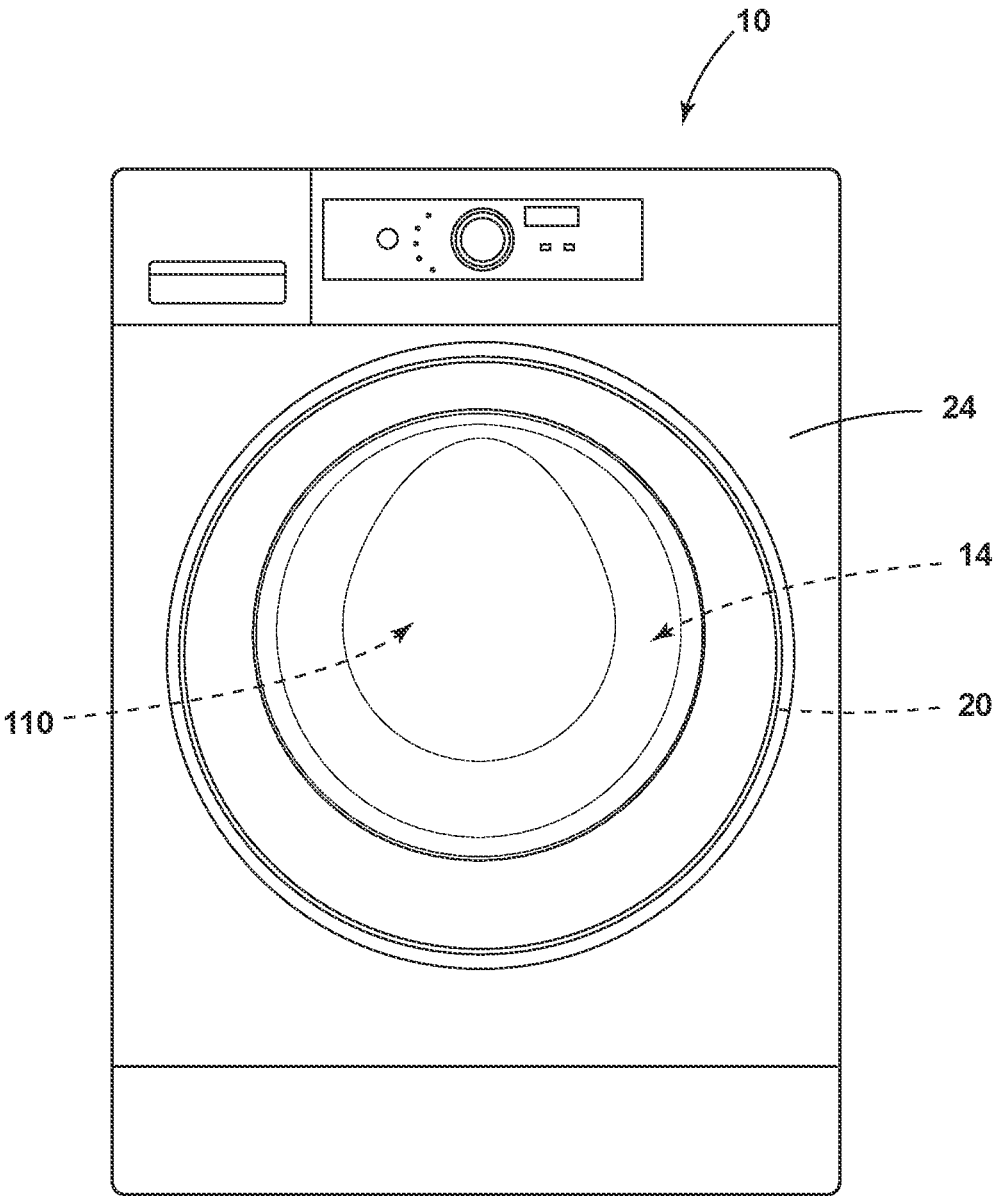
FIG. 1 is a front elevational view of a combination washing and drying appliance incorporating an aspect of the filter cleaning assembly.
Figure 2:
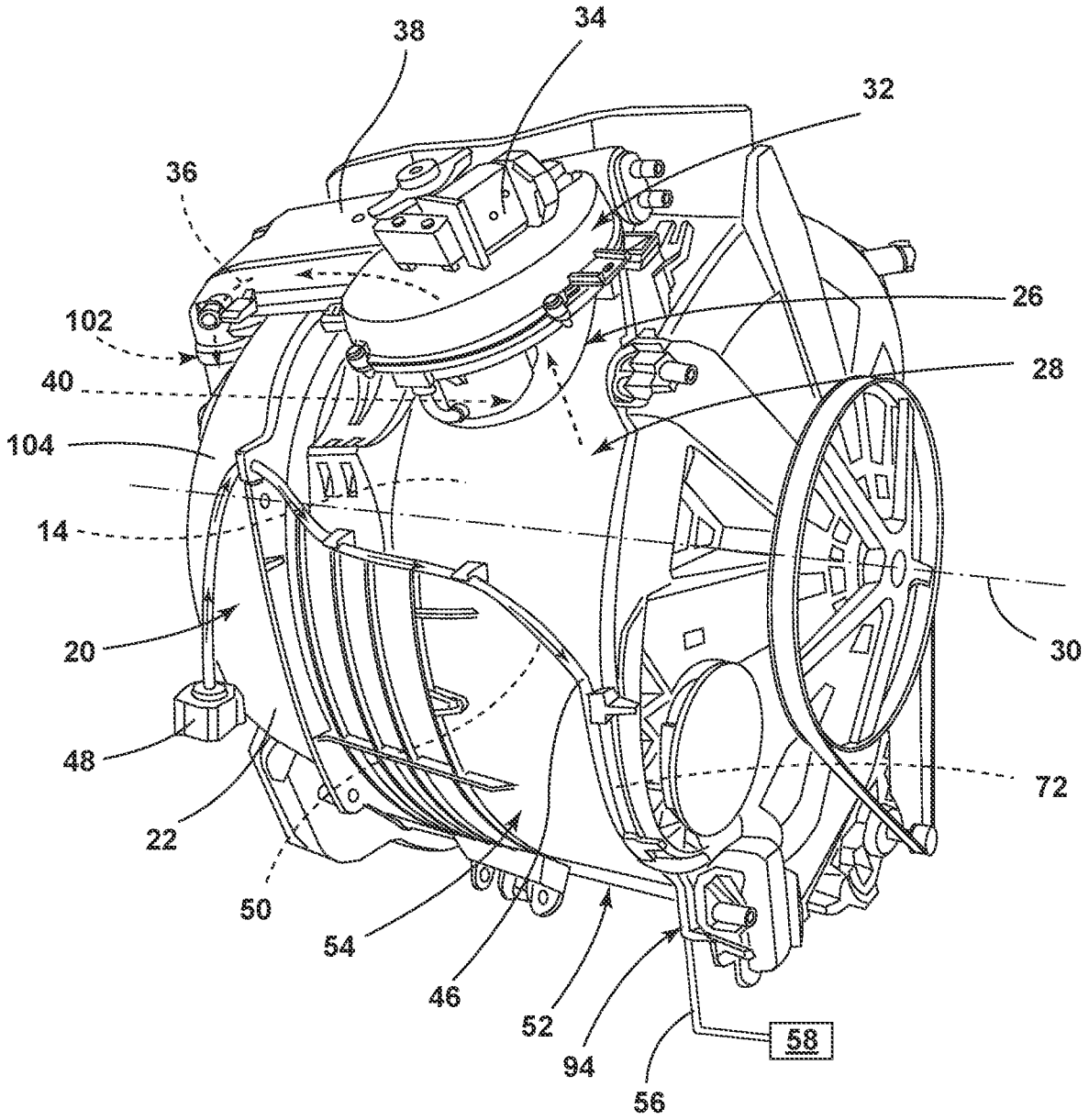
FIG. 2 is a perspective view of a combination washing and drying appliance with the outer cabinet removed.
Figure 3:
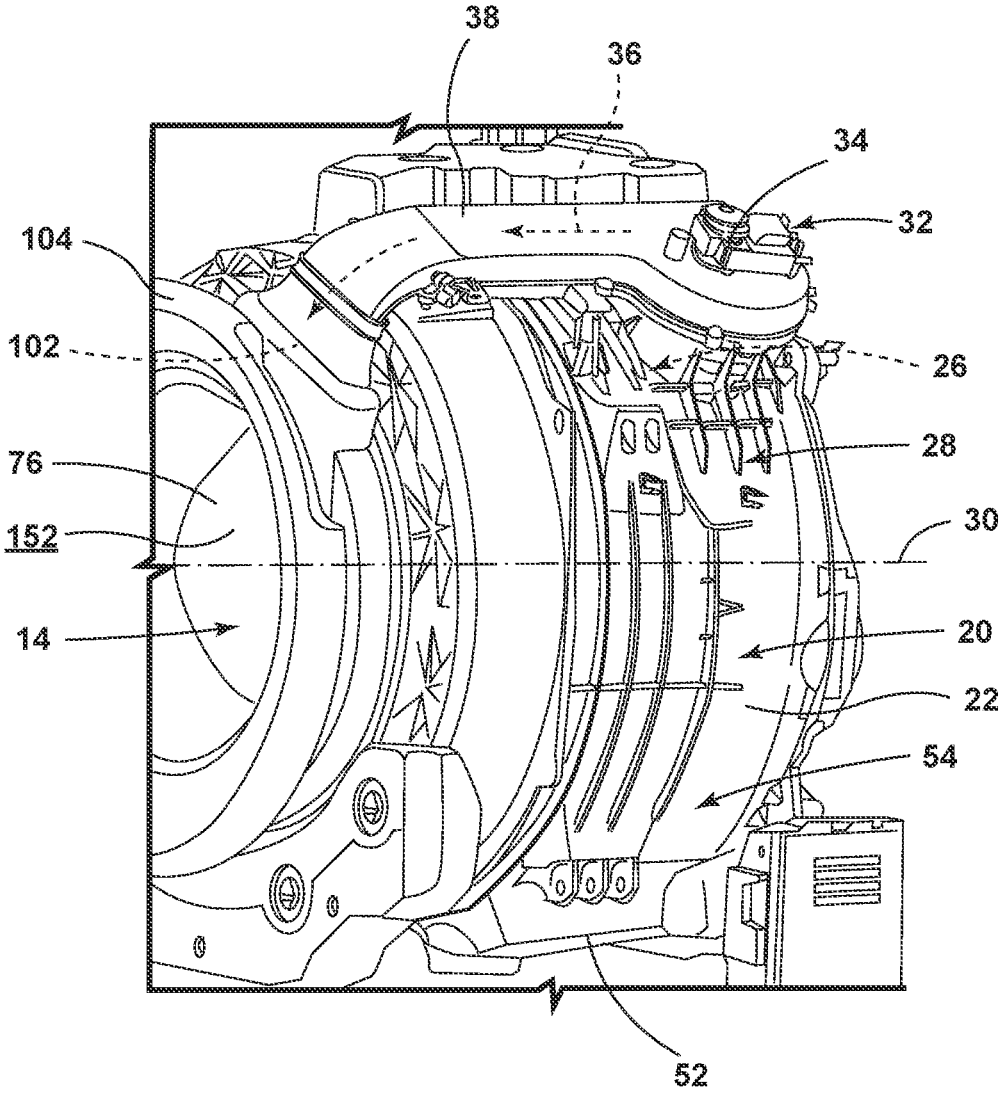
FIG. 3 is a perspective view of an aspect of a combination washing and drying appliance with the outer cabinet removed.
Figure 4:
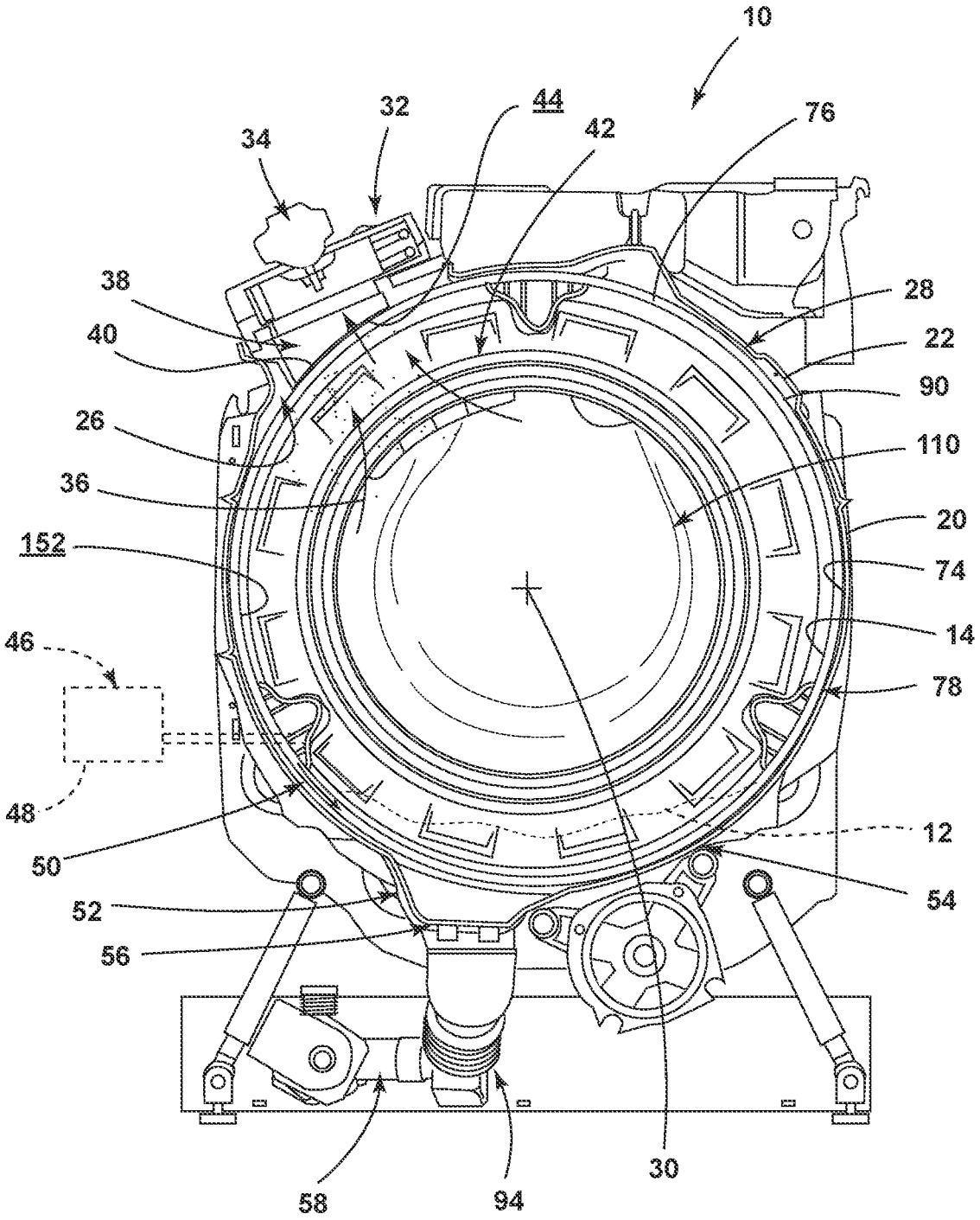
FIG. 4 is a cross-sectional view of the combination washing and drying appliance of FIG. 3 taken along line IV-IV.
Figure 5:
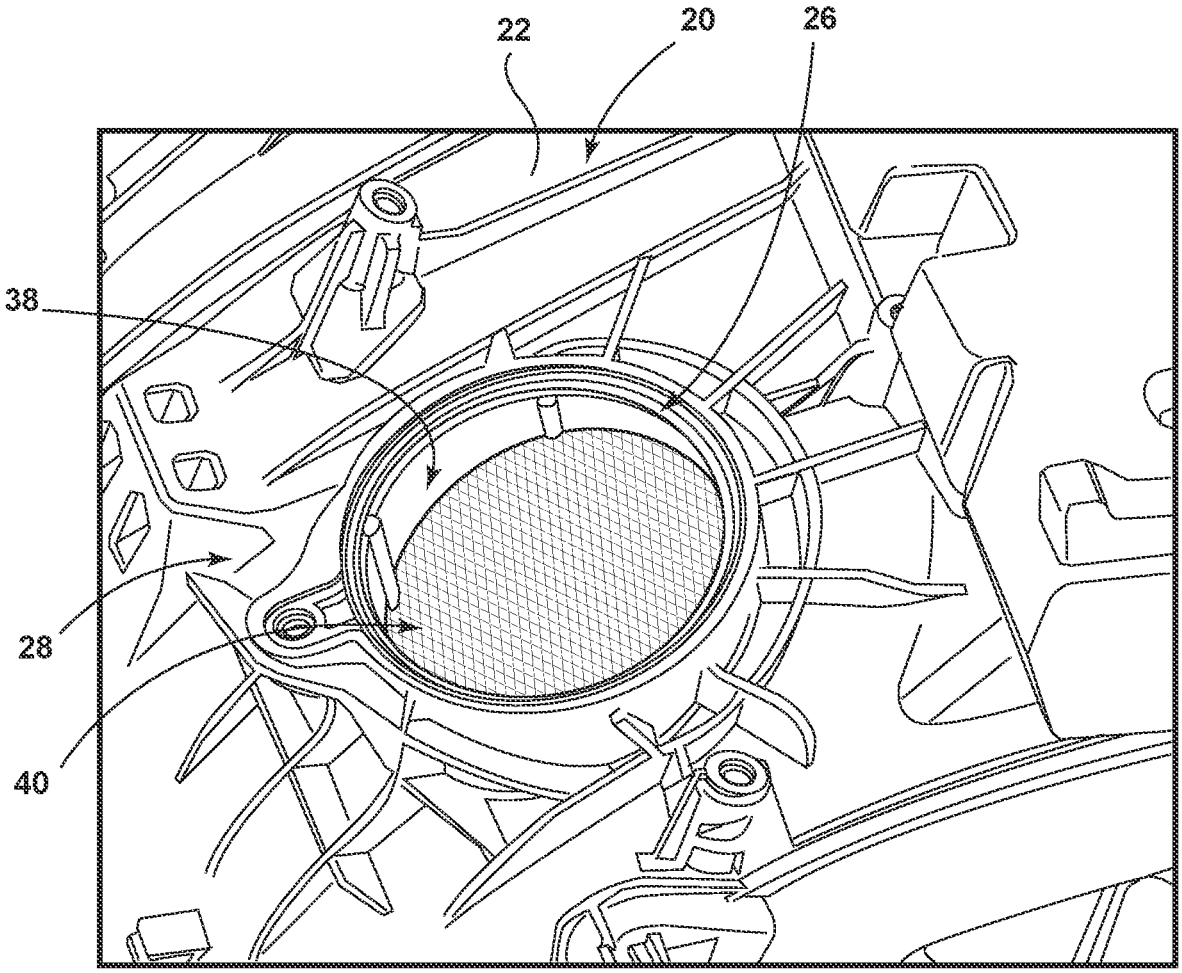
FIG. 5 is a top perspective view of an aspect of the combination washing and drying appliance of FIG. 3 with the blower removed and showing an aspect of the air outlet with the lint filter installed therein.
Figure 6:
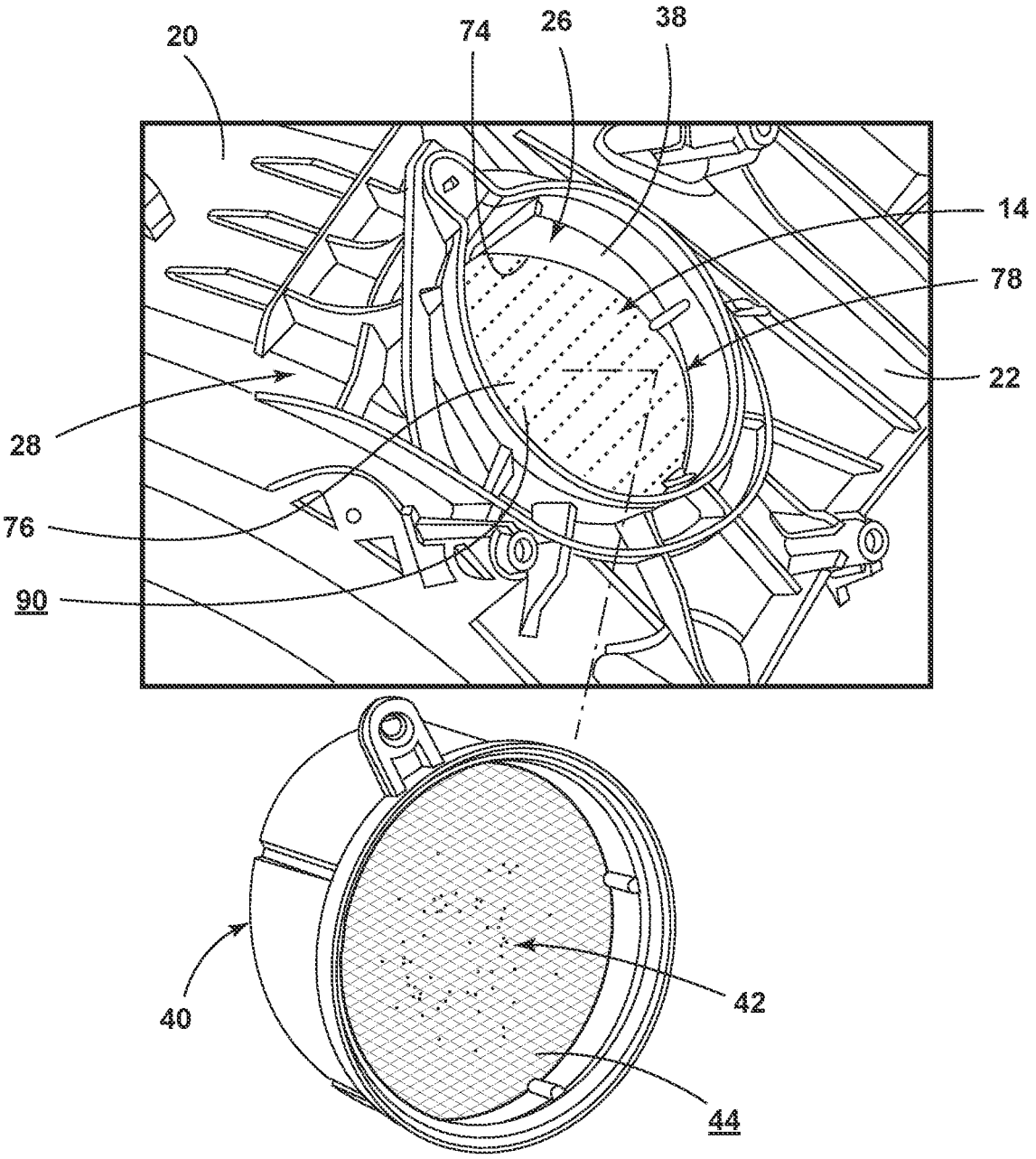
FIG. 6 is a partially exploded perspective view of the combination washing and drying appliance of FIG. 5 and showing a lint filter removed from the air outlet.
Figure 7:
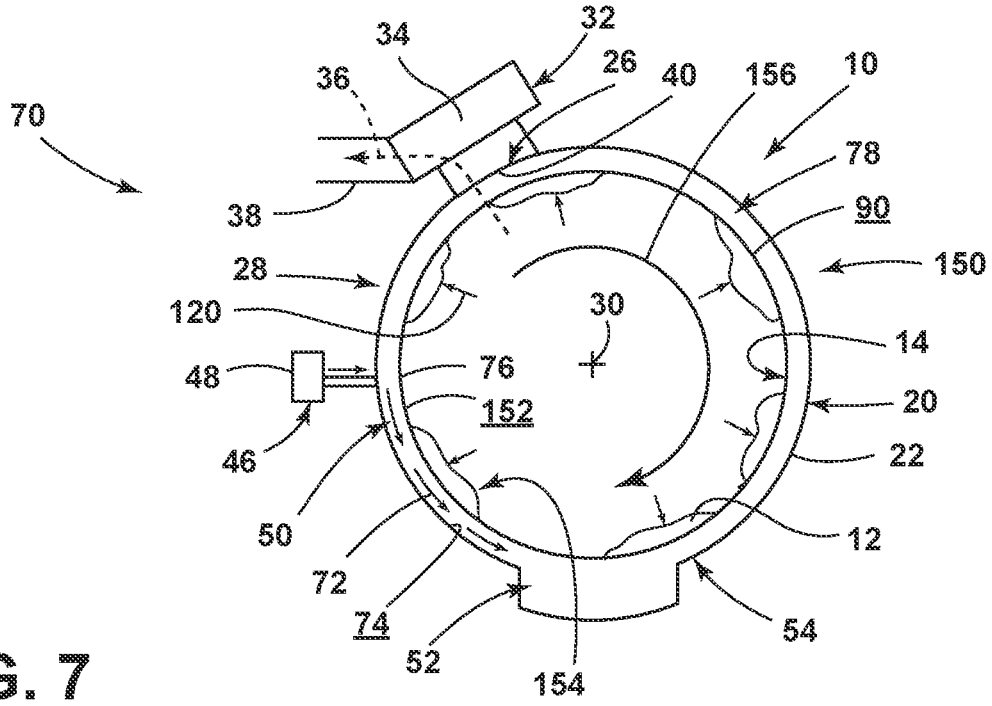
FIG. 7 is a schematic perspective view of an aspect of the filter cleaning assembly and showing a distributing step for balancing the articles contained within the drum along the inner surface of the drum.
Figure 8:
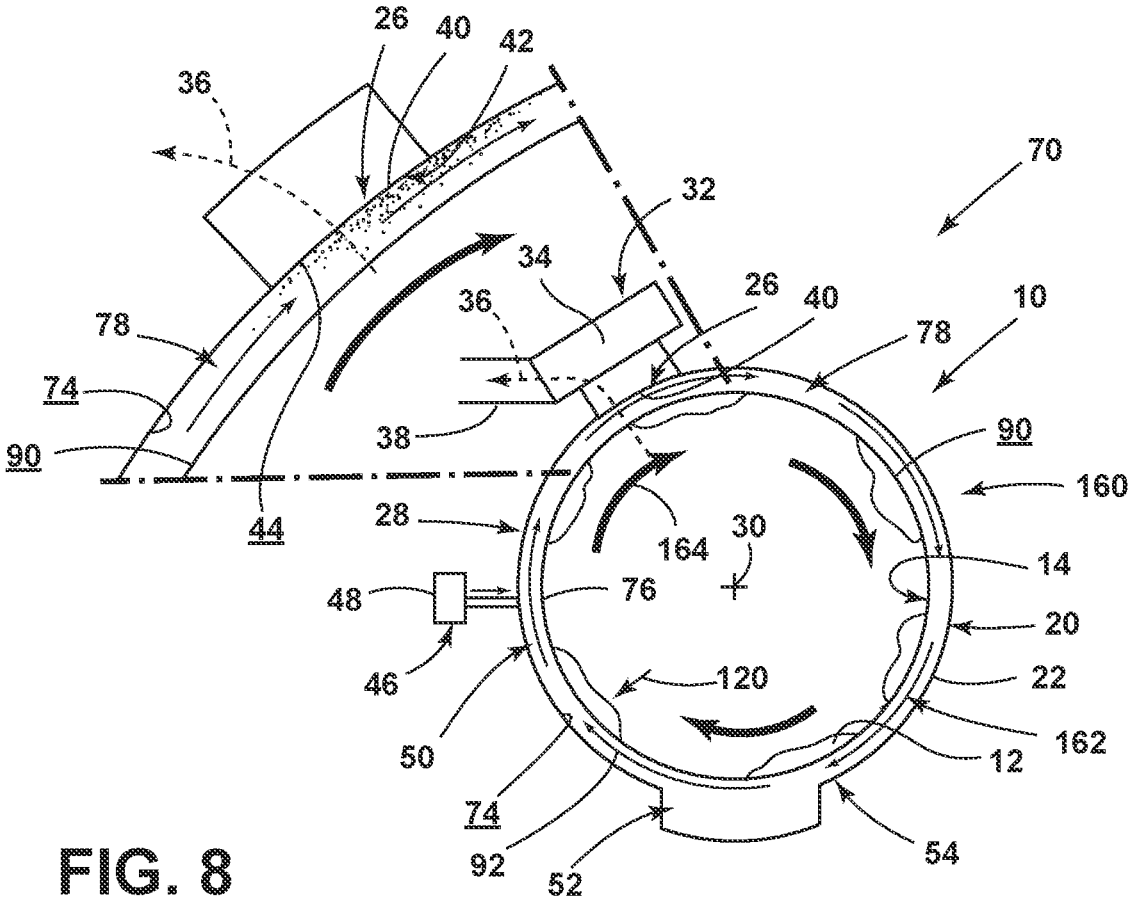
FIG. 8 is a schematic view of the combination washing and drying appliance of FIG. 7 and showing the drum rotating at a high rate of speed to circulate wash fluid through an interstitial space defined between the drum and the tub.
Figure 9:
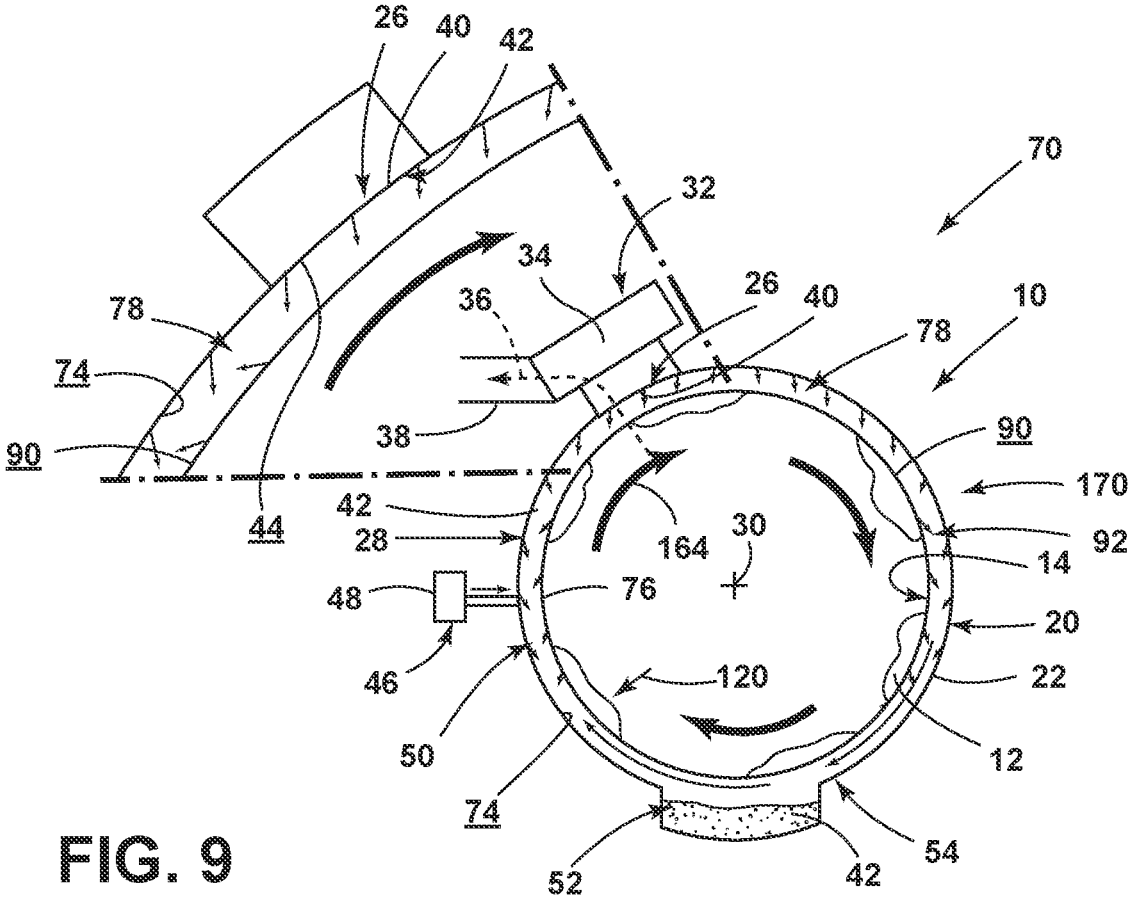
FIG. 9 is a schematic cross-sectional view of the tub and drum of FIG. 8 and showing a collection phase of the filter cleaning assembly where wash fluid and particulate are collected within a sump without allowing the wash fluid and particulate to enter the inside of the drum.
Figure 10:
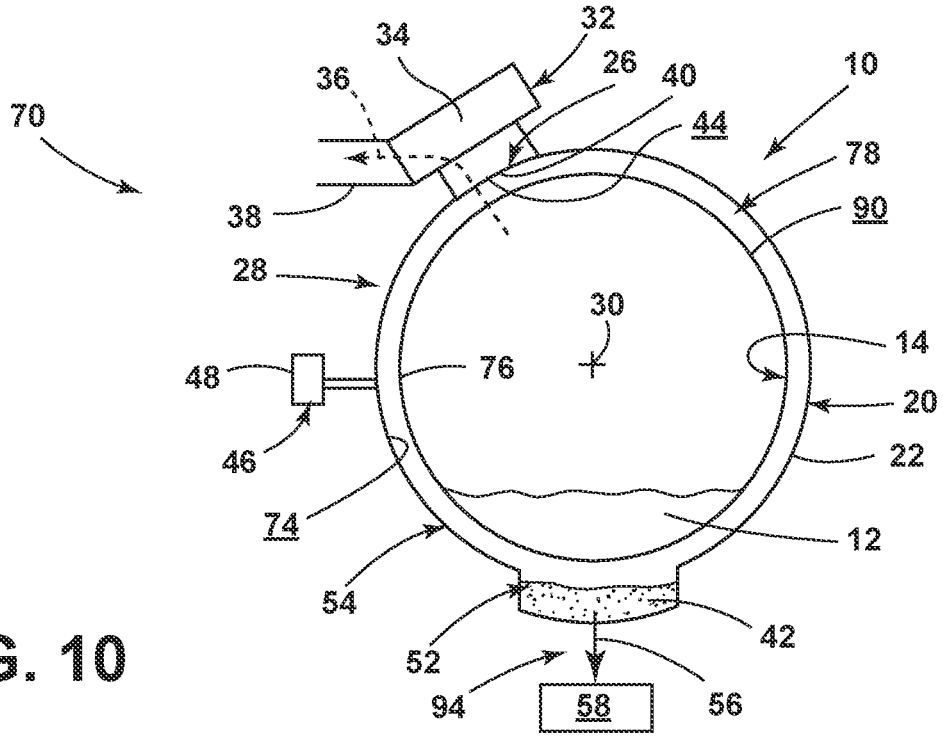
FIG. 10 is a schematic cross-sectional view of the drum and tub of FIG. 9 and showing a draining phase where the wash fluid and particulate are delivered away from the tub via the fluid pump.

The components in the figures are not necessarily to scale, emphasis instead being placed upon illustrating the principles described herein.

DETAILED DESCRIPTION

The present illustrated embodiments reside primarily in combinations of method steps and apparatus components related to a combination washing and drying appliance having a lint filter installed within a tub and configured to perform a filter cleaning phase that removes particulate from the lint filter during performance of a drying cycle and without removing articles from the rotating drum and also without allowing fluid to enter into the drum that may saturate the articles being dried. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-10, reference numeral 10 generally refers to a laundry appliance, and typically a combination washing and drying appliance that can perform both washing and drying functions with respect to the articles 12 being processed. In this manner, a user can place articles 12 within a drum 14 of the appliance 10 and the appliance 10 will perform both washing and drying functions such that two appliances 10 are not needed to process the articles 12.

According to the various aspects of the device, as exemplified in FIGS. 1-10, the appliance 10 includes a tub 20 having a wall 22, where the tub 20 is positioned within an outer cabinet 24. The tub 20 includes an air outlet 26 that is positioned through an upper portion 28 of the wall 22. The drum 14 rotationally operates within the tub 20 and typically about a horizontal or angled rotational axis 30. An air handling system 32 that includes a blower 34 for moving process air 36 through an airflow path 38 is attached to the wall 22 of the tub 20. A lint filter 40 is disposed within the air outlet 26. The lint filter 40 filters particulate 42 from the process air 36 that enters the airflow path 38 from the tub 20. Accordingly, during operation of the blower 34 for the air handling system 32, process air 36 is drawn from within the tub 20 and moves through the air outlet 26 to be filtered by the lint filter 40. During this process, particulate 42 is captured within the lint filter 40 and can accumulate on an interior surface 44 of the lint filter 40 that faces the inside of the tub 20. A fluid delivery system 46 is also attached to the tub 20. The fluid delivery system 46 includes a valve 48 that operates to deliver wash fluid 50, typically water, into the inside of the tub 20. A sump 52 is defined within the lower portion 54 of the tub 20 and below the drum 14. The sump 52 includes a drain 56 that moves wash fluid 50 and particulate 42 from inside of the tub 20 to an external outlet 58. This external outlet 58 can be in the form of an external drain 56, a removable water bottle, combinations thereof and other similar mechanisms for disposing, recycling or recirculating the wash fluid 50.

Referring again to FIGS. 1-10, the appliance 10 described herein includes the lint filter 40 within the air outlet 26 and operates in the absence of a condenser attached to the tub 20. In certain alternative appliances, this condenser forms a part of the air path and assists in removing lint particles. This condenser is typically positioned along the exterior surface of the tub. The appliance 10 described herein is manufactured to operate without this condenser and utilizes the lint filter 40 in the air outlet 26 for separating particulate 42 from the process air 36.

Referring again to FIGS. 1-10, the combination washing and drying appliance 10 is configured to perform a filter cleaning phase 70. During the filter cleaning phase 70, the fluid delivery system 46 delivers impulse amounts 72 of a wash fluid 50 into the tub 20. These impulse amounts 72 of wash fluid 50 are typically very small amounts that slowly move along the inside surface of the tub 20 using the phenomena of surface adhesion. Using surface adhesion, this wash fluid 50 moves along the inside surface without being splashed or dropping onto the drum 14 or through the perforated wall 76 that forms the drum 14. Accordingly, during the impulse operation of the valve 48, the wash fluid 50 entering into the tub 20 is maintained separate from the drum 14 so as to not saturate the articles 12 contained within the drum 14. Accordingly, during the filter cleaning phase 70, the articles 12 remain within the drum 14 and the wash fluid 50 is maintained within an interstitial space 78 inside of the tub 20 and outside of the drum 14.

During this filter cleaning phase 70, the drum 14 operates to direct the wash fluid 50 within the drum 14 and around the outside surface 90 of the tub 20. To accomplish this, the drum 14 rotates at a high rate of speed using the process of air ventilation 162 within the interstitial space 78 defined between the drum 14 and the tub 20. As the drum 14 rotates at a high rate of speed, the wash fluid 50 defines circulated fluid 92 that is circulated along the inside surface of the tub 20 and also circulated over the interior surface 44 of lint filter 40. Accordingly, the circulated fluid 92 is moved across the interior surface 44 of the lint filter 40 to remove particulate 42 from the lint filter 40. The wash fluid 50 and particulate 42 are then collected within the sump 52. A fluid pump 94 that is coupled with the sump 52 directs the wash fluid 50 and particulate 42 to the external outlet 58. Initially, the circulated fluid 92 includes the wash fluid 50. As the filter cleaning phase 70 is performed, the wash fluid 50 moves across the interior surface 44 of the lint filter 40 and removes the particulate 42 therefrom. In this manner, the circulated fluid 92, over time, includes greater and greater amounts of the particulate 42 that is added to the wash fluid 50.

During operation of the appliance 10, typically a drying phase 100, the air handling system 32 operates to move process air 36 through the airflow path 38. In this manner, the air handling system 32 operates to move process air 36 from inside the tub 20 and through the air outlet 26 and into the airflow path 38 of the laundry appliance 10. As the process air 36 moves through the air outlet 26, the process air 36 and particulate 42 move through the lint filter 40. At the lint filter 40, the particulate 42 is separated from the process air 36 and is captured and temporarily retained on the interior surface 44 of the lint filter 40. In certain aspects of the device, the air handling system 32 can also include a heater as well as other air conditioning systems that can be used for heating, cooling and dehumidifying the process air 36 within the appliance 10. Accordingly, as the process air 36 moves through the air outlet 26 and the air handling system 32, the process air 36 is filtered and conditioned for delivery back into the tub 20 via an air inlet 102 at the front 104 of the tub 20.

Referring again to FIGS. 3-10, the filter cleaning phase 70 is configured to operate while the articles 12 being dried are contained within a processing space 110 defined within the perforated wall 76 of the drum 14. Using the rotational operation of the drum 14 as well as the impulse operation of the valve 48 for delivering small amounts of wash fluid 50 into the tub 20, the wash fluid 50 is maintained within the interstitial space 78 and separated from the drum 14. In this manner, the wash fluid 50 is prevented from entering into the drum 14 and saturating the articles 12.

It is contemplated that certain amounts of wash fluid 50 may inadvertently move into the inside of the drum 14 through the perforated wall 76 via splashing and other inadvertent movements of the wash fluid 50. However, using the rotation of the drum 14 and the impulse operation of the valve 48, this amount of fluid is kept to a minimum such that substantially all of the wash fluid 50 is maintained between the rotating drum 14 and the tub 20. The term "substantially" in this regard is meant to reflect that approximately five percent or less than approximately give percent of the wash fluid 50 used during the filter cleaning phase 70 enters into the drum 14. As will be described more fully below, the drum 14 is typically configured to rotate during the entire filter cleaning phase 70. Accordingly, wash fluid 50 and particulate 42 that engages the outer surface of the rotating drum 14 is typically shed away from the rotating drum 14 through centrifugal force 120.

Referring again to FIGS. 3-10, it is contemplated that a filter cleaning phase 70 is initiated between sequential drying phases 100. By way of example, and not limitation, where a first drying cycle 130 is performed, the articles 12 contained within the drum 14 may not be completely dried or may not be dried to the level desired by the user of the appliance 10. Accordingly, a second drying cycle 132 can be operated immediately after the first drying cycle 130. After completion of the first drying cycle 130, the lint filter 40 typically has at least some particulate 42 captured within the interior surface 44 thereof. Accordingly, use of the filter cleaning phase 70 is utilized for removing this accumulated particulate 42 from the lint filter 40 to ensure proper movement of the process air 36 through the drum 14, the tub 20 and the airflow path 38 for drying the articles 12. After completion of the filter cleaning phase 70, where particulate 42 is removed from the lint filter 40, the selected second drying cycle 132 is performed. It is contemplated that upon selection of the second drying cycle 132 to be performed immediately after the first drying cycle 130, the filter cleaning phase 70 is automatically operated as an initial portion of the second drying cycle 132.

Referring again to FIGS. 3-10, it is also contemplated that the filter cleaning phase 70 can be performed during an interruption 140 of the drying cycle 130. The interruption 140 can be initiated by a sensor that detects an amount of particulate 42 that is entrapped on the interior surface 44 of the lint filter 40. The filter cleaning phase 70 can be performed during this interruption 140. After the filter cleaning phase 70 is complete, the drying cycle 130 being performed is continued until completed, or until such time as the filter cleaning phase 70 is performed again.

Referring again to FIGS. 3-10, where the filter cleaning phase 70 is performed during interruption 140 in a drying phase 100 being performed, articles 12 are present within the processing space 110 during this interruption 140. As described herein, during performance of the filter cleaning phase 70, wash fluid 50 used during this filter cleaning phase 70 is maintained within the interstitial space 78 defined between the drum 14 and the tub 20. The use of impulse operations of the valve 48 and continuous rotation of the drum 14, or substantially continuous rotation of the drum 14, during this filter cleaning phase 70 helps to maintain the wash fluid 50 and the particulate 42 within this interstitial space 78. Accordingly, the articles 12 being dried are not saturated or substantially saturated with the wash fluid 50 used during the filter cleaning phase 70.

Referring now to FIGS. 5-12, the filter cleaning phase 70 includes a low speed balancing phase 150 wherein the drum 14 rotates at a first speed 156. This low speed balancing phase 150 is used to distribute the articles 12 contained within the drum 14 along an inner surface 152 of the drum 14. During this low speed balancing phase 150, the articles 12 are distributed around the inner surface 152 to define a balanced state 154 of the articles 12. In this balanced state 154 of the articles 12, the drum 14 is configured to smoothly rotate about the rotational axis 30 of the drum 14 without significant wobbling or oscillation. Wobbling or oscillation of the drum 14 and the tub 20 may result in unwanted splashing of the wash fluid 50 onto the rotating drum 14 during performance of the filter cleaning phase 70. Accordingly, by placing the articles 12 in the balanced state 154, the relative motion of the drum 14 and the tub 20 within the cabinet 24 remains substantially limited throughout the filter cleaning phase 70 so as to not disrupt the surface adhesion of the wash fluid 50 against the inside surface of the tub 20. This allows the impulse amounts 72 of wash fluid 50 to move along the inside surface of the tub using surface adhesion.

Referring again to FIGS. 7-12, during the low speed balancing phase 150, the valve 48 operates intermittently, and through the impulse operations, to deliver the impulse amounts 72 of wash fluid 50. As described herein, these impulse amounts 72 of wash fluid 50 travel along with the inside surface of the tub 20 and toward the sump 52 using the phenomena of surface adhesion. Typically, a fluid inlet of the fluid delivery system 46 is located below a midpoint of the tub 20 defined by the rotational axis 30 to allow the fluid to run along the inside surface of the tub 20. Using surface adhesion, it is contemplated that the fluid inlet can be located at a position above the midpoint of the tub 20. Surface adhesion allows the wash fluid 50 to flow along and adhere to the inside surface of the tub 20.

According to the various aspects of the device, the amount of wash fluid 50 utilized during the filter cleaning phase 70 can vary. By way of example, and not limitation, the valve 48 can operate one time per ten seconds to release small impulse amounts 72 of wash fluid 50 into the tub 20. Over the course of approximately 10 minutes, approximately 5 deciliters (approximately 0.5 liters) of wash fluid 50 can be delivered into the tub 20. It is contemplated that greater or lesser amounts of wash fluid 50 can be delivered into the tub 20 for accomplishing the filter cleaning phase 70. Typically the amount of wash fluid 50 delivered into the tub 20 will depend at least upon the amount of space available within the tub 20 and below the drum 14. Additionally, to maintain the balanced state 154 of the articles 12 contained within the drum 14, the drum 14 is configured to rotate continuously as the valve 48 operates the impulse activations to slowly deliver the wash fluid 50 into the tub 20. This rotation of the drum 14 to achieve the balanced state 154 of the articles 12 can be a rotational speed of approximately 70 rotations per minute to approximately 150 rotations per minute. In certain aspects of the device, approximately 90 rotations per minute are utilized to achieve the balanced state 154 of the articles 12.

Referring again to FIGS. 7-12, the filter cleaning phase 70 also includes a high speed cleaning phase 160 that is characterized by the drum 14 rotating at a second speed 164 that is a high rate of speed and faster than the first rate of speed. At this second speed 164, the movement of the drum 14 relative to the interstitial space 78 causes a process of air ventilation 162 that moves the wash fluid 50 as circulated fluid 92 through the interstitial space 78 and along the inside surface of the tub 20. As this circulated fluid 92 is moved along the inside surface of the tub 20, this circulated fluid 92 is also moved along the interior surface 44 of the lint filter 40 for separating particulate 42 from the lint filter 40.

According to various aspects of the device, this high speed cleaning phase 160 of the drum 14 is configured to operate at approximately 800 revolutions per minute. Other rotational speeds of the drum 14 are also contemplated. These rotational speeds are typically sufficient to generate the process of air ventilation 162 within the interstitial space 78 that causes the circulation of the wash fluid 50 along the inside surface of the tub 20. To achieve the proper movement of the circulated fluid 92 within the interstitial space 78 and along the inside surface of the tub 20, this high speed cleaning phase 160 can last from approximately 60 seconds to approximately 100 seconds. It is also contemplated that other time periods for operating the high speed cleaning phase 160 can be utilized.

Referring again to FIGS. 7-12, after completion of the high speed cleaning phase 160, the drum 14 operated a collecting phase 170 where the drum 14 slows to a third speed 172 that is slower than the second speed 164 utilized during the high speed cleaning phase 160. The third speed 172 may be the same as the first speed 156 used during the low speed balancing phase 150 or may be between the first speed 156 and the second speed 164. During this collecting phase 170 of the filter cleaning phase 70, the drum 14 slows such that the effect of air ventilation 162 is diminished. Accordingly, the wash fluid 50 that has been circulated along the inside surface of the tub 20 falls from the inside surface of the tub 20 or moves along the inside surface of the drum 14 under the force of gravity. Certain portions of this wash fluid 50 as well as the particulate 42 may fall onto an outside surface 90 of the drum 14. Because the drum 14 is rotating at the third speed 172, this wash fluid 50 and particulate 42 are shed from the outside surface 90 of the drum 14 utilizing centrifugal force 120. Accordingly, the wash fluid 50 that falls upon the outer surface of the drum 14 is quickly shed from the outside surface 90 and directed to the inside surface of the tub 20 to be directed to the sump 52.

As described herein, the wash fluid 50 is shed from the outside surface 90 of the drum 14 and moved toward the inside surface of the tub 20. This wash fluid 50 can move along the tub 20 using the phenomena of surface adhesion. During this collecting phase 170 where the drum 14 rotates at the third speed 172, the fluid pump 94 that is attached to the sump 52 for the tub 20 begins to operate. Accordingly, as the wash fluid 50 and particulate 42 are collected within the sump 52, the fluid pump 94 extracts the wash fluid 50 and particulate 42 and moves it to the external outlet 58. By operating the fluid pump 94 during the performance of the collecting phase 170 of the filter cleaning phase 70, as wash fluid 50 and particulate 42 are moved into the sump 52, these materials are expediently moved to the external outlet 58 such that large amounts of wash fluid 50 and particulate 42 cannot collect within the sump 52. Large amounts of wash fluid 50 and particulate 42 may result in splashing of wash fluid 50 onto the drum 14. By keeping only minimal amounts of wash fluid 50 within the sump 52, the chances of this splashing occurring are kept to a minimum.

Figure 11:
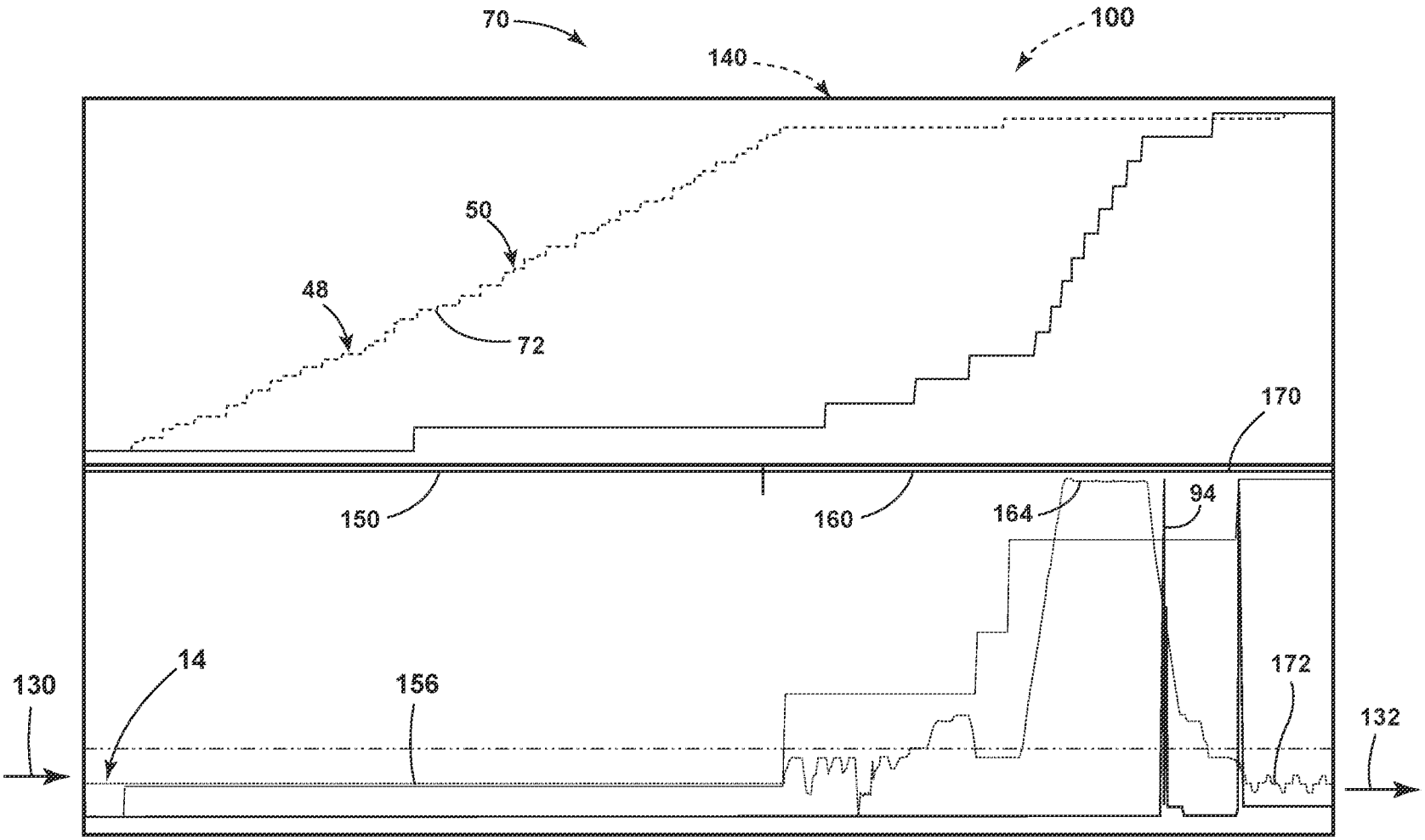
FIG. 11 is a schematic diagram showing operation of various components of the combination washing and drying appliance during performance of the filter cleaning phase of a particular laundry cycle.
Figure 12:
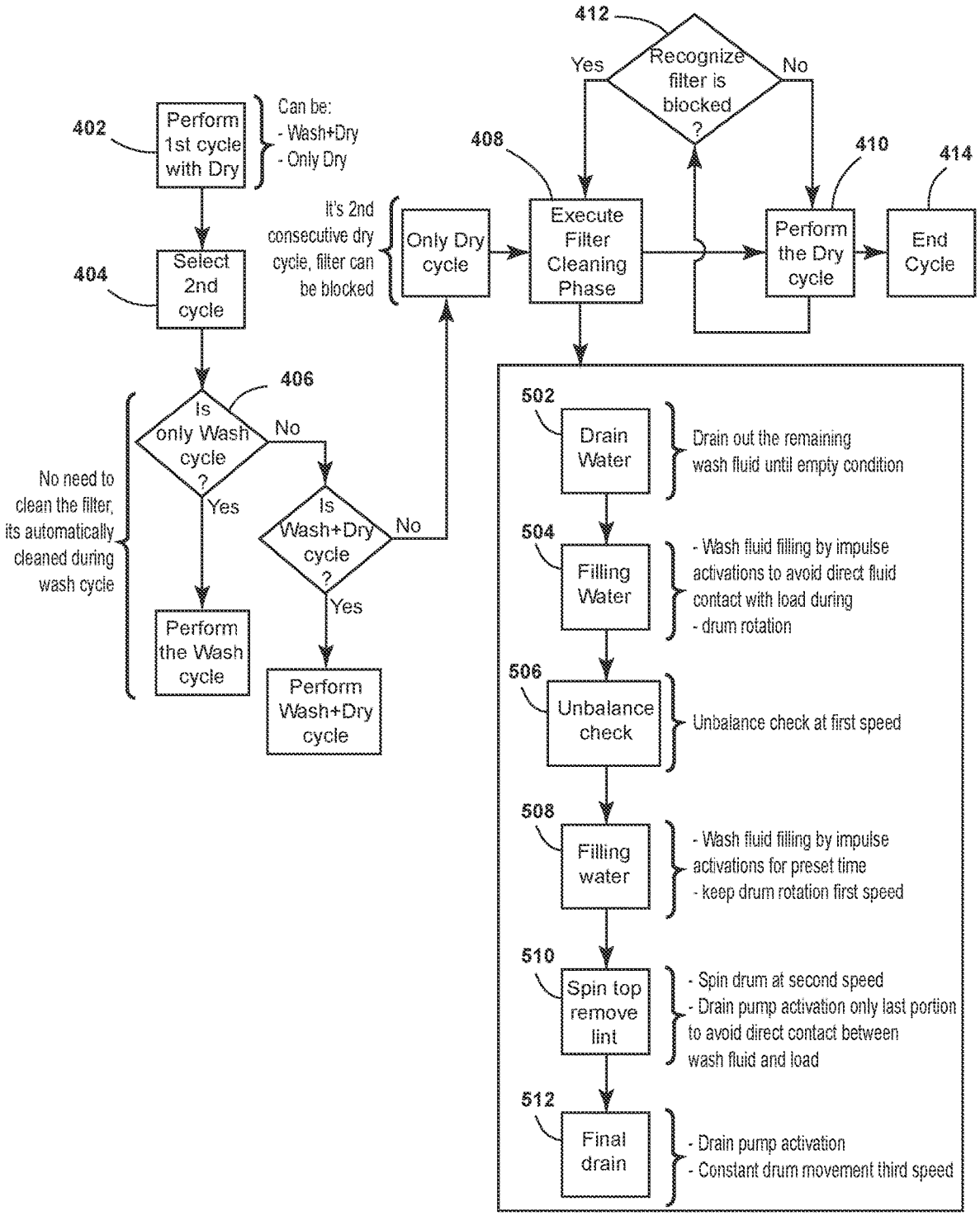
FIG. 12 is a schematic diagram illustrating a process for determining whether the filter cleaning phase should be initiated and also showing performance of the filter cleaning phase.
Figure 13:
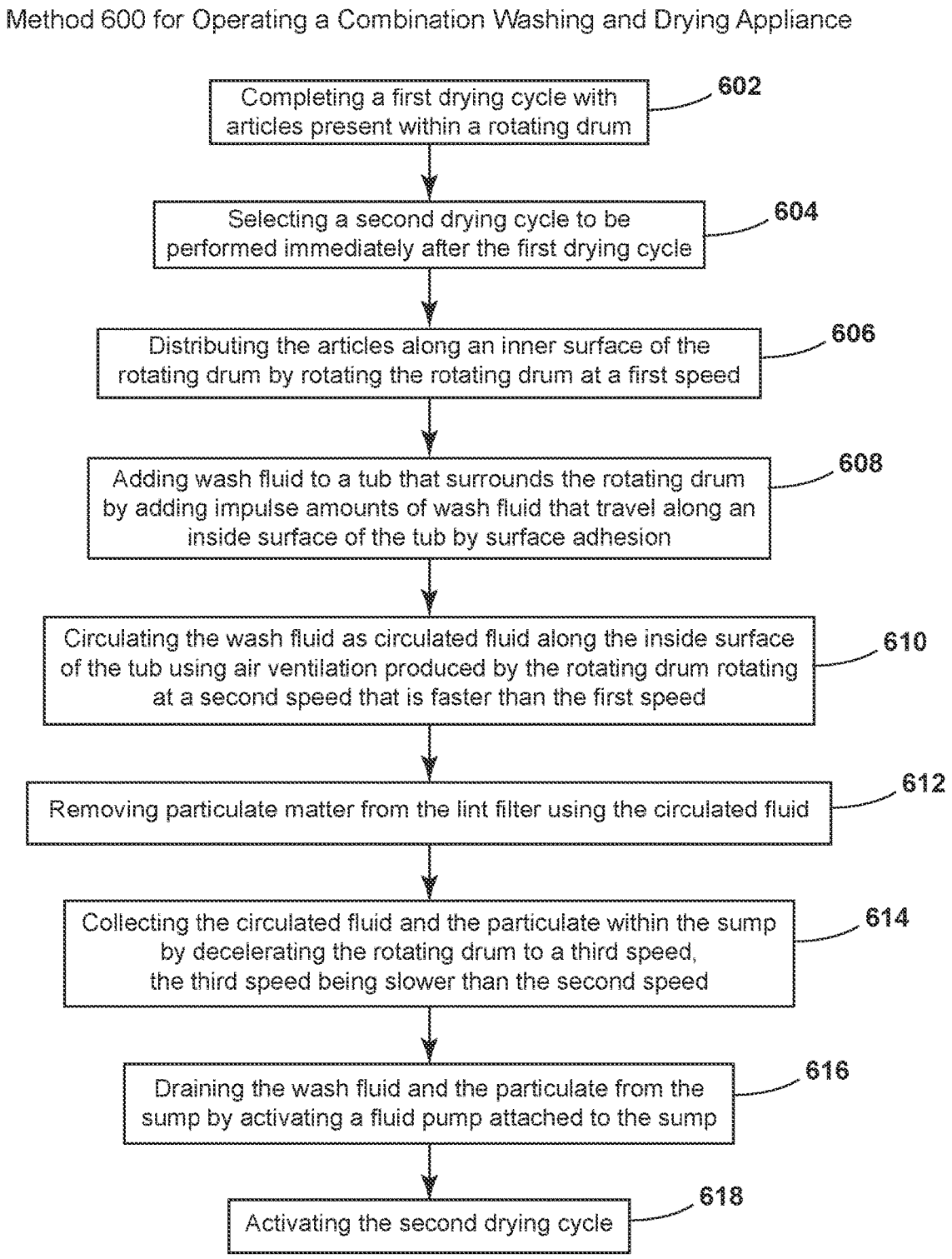
FIG. 13 is a linear flow diagram illustrating a method for operating a combination washing and drying appliance.
Figure 14:
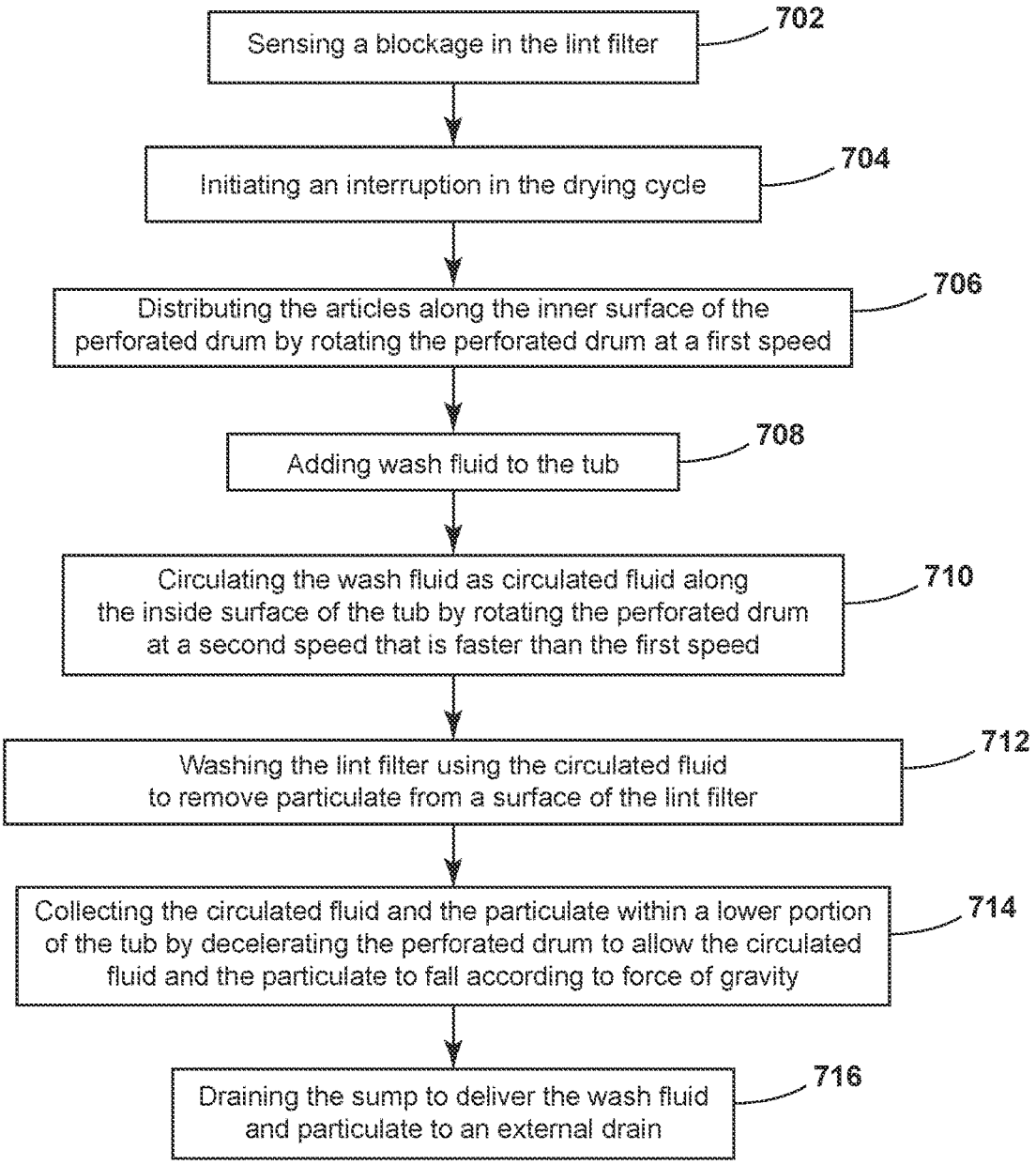
FIG. 14 is a linear flow diagram illustrating a method for cleaning a lint filter located within a tub of a combination washing and drying appliance during performance of a drying phase of a laundry cycle and where articles are located within a perforated drum that rotates within the tub.

Referring now to the schematic diagrams of FIGS. 11-12 that show exemplary aspects of the operation of the appliance 10 and how the filter cleaning phase 70 can be integrated into the laundry cycles. FIG. 11 reflects an exemplary operation of the appliance 10 during the filter cleaning phase 70. Additionally, FIG. 12 reflects a flow diagram for determining whether the filter cleaning phase 70 should be operated or not.

According to the flow diagram of FIG. 12, step 402 includes performing a first cycle that includes a drying phase 100, such as the first drying cycle 130. This may include a washing and drying phase 100 or just a drying phase 100. Step 404 includes selecting a second cycle. The decision of step 406 determines whether this second cycle is only a wash cycle, is a wash and dry cycle or is only a dry cycle. Only where the second cycle is the second drying cycle 132 will the filter cleaning phase 70 be initiated. Where the cycle includes only washing or both washing and drying, the filter will be cleaned during the washing cycle and the filter cleaning phase 70 will not be initiated. According to step 408, the filter cleaning phase 70 is initiated and the clothes are desired to be dried beyond the level provided by the first drying cycle 130. Step 410 reflects that the second drying cycle 132 is performed. The decision of step 412 includes the use of a sensor for determining the amount of particulate 42 captured by the lint filter 40. Where the lint filter 40 is blocked or blocked a certain percentage, the decision of step 412 can reinitiate the filter cleaning phase 70 to remove accumulated amounts of particulate 42 from the lint filter 40. When the filter cleaning phase 70 is complete, step 410 for performing the second drying cycle 132 is completed and the cycle is ended (step 414.

Referring again to FIGS. 11-12, the filter cleaning phase 70 includes step 502 of draining any wash fluid 50 from the sump 52 that may be contained within the sump 52 or the remainder of the tub 20. Step 504 includes using impulse activations of the valve 48 to provide small impulse amounts 72 of wash fluid 50 into the tub 20 and using surface adhesion for directing this fluid towards the sump 52. An unbalanced check is performed at step 506 for determining whether the articles 12 are properly distributed into the balanced state 154. During the unbalanced check, also referred to herein as the low speed balancing phase 150, the drum 14 is rotated at the first speed 156 to distribute the articles 12 evenly throughout the inner surface 152 of the drum 14. Step 508 includes continuing to fill wash fluid 50 into the tub using the impulse activations of the valve 48. This step 508 can occur for various periods of time. By way of example, and not limitation, this activation of the valve 48 can continue for approximately 30 seconds as the drum 14 continues to rotate at the first speed 156 indicative of the low speed balancing phase 150. When the proper amount of wash fluid 50 is contained within the drum 14, step 510 includes spinning the drum 14 at the second speed 164 to perform the high speed cleaning phase 160.

Referring again to FIGS. 11-12, toward the end of this high speed cleaning phase 160, the fluid pump 94 can be activated to begin to remove wash fluid 50 and captured particulate 42 from the tub 20 and to the external outlet 58. Step 512 includes operating the fluid pump 94 for draining the wash fluid 50 and captured particulate 42 from the sump 52 and moving this wash fluid 50 and captured particulate 42 to the external outlet 58. As the fluid pump 94 operates, the drum 14 can be slowed to the third speed 172. To ensure that wash fluid 50 does not enter into the interior of the drum 14, the drum 14 can be rotated at a fourth speed to utilize the centrifugal force 120 for shedding wash fluid 50 from the outside surface 90 of the drum 14. By way of example, and not limitation, this fourth speed can include approximately RPM, and typically approximately 27 RPM. This can occur for approximately 90 seconds.

According to the various aspects of the device, the various speeds that are utilized for rotating the drum 14 and time periods which the drum 14 is rotated can vary depending on certain factors. Such factors can include, but are not limited to, the size of the tub 20 and drum 14 for the appliance 10, the amount of articles 12 being processed, the type of articles 12 being processed and other similar factors that may affect the speed at which the drum 14 has been rotated and the amount of time in which the drum 14 has rotated to deliver the amount of wash fluid 50 desired. The time taken to deliver the amount of wash fluid 50 needed for the filter cleaning phase 70 can also vary.

Referring now to FIGS. 1-13, having described various aspects of the device, a method 600 is disclosed for operating a combination washing and drying appliance 10, in particular, operating a filter cleaning phase 70 of a combination washing and drying appliance 10. According to the method 600, step 602 includes completing a first drying cycle 130 where articles 12 are present within the drum 14 that rotates within the tub 20. A second drying cycle 132 is selected (step 604). This second drying cycle 132 is selected to be performed immediately after the first drying cycle 130, without an intervening washing cycle performed between. After selecting the second drying cycle 132, step 606 includes distributing the articles 12 along an inner surface 152 of the rotating drum 14 by rotating the rotating drum 14 at the first speed 156. As the articles 12 are distributed to define the balanced state 154, as described herein (or after the balances state is achieved), wash fluid 50 is added to the tub 20 by adding impulse amounts 72 of wash fluid 50 that travel along an inside surface 74 of the tub 20 using surface adhesion (step 608). The wash fluid 50 is then circulated in the form of circulated fluid 92 along the inside surface 74 of the tub 20 using air ventilation 162 produced by the rotation of the drum 14 rotating at a second speed 164 that is faster than the first speed 156 (step 610). Particulate 42 is then removed from the lint filter 40 using the circulated fluid 92 (step 612). The circulated fluid 92 and the particulate 42 removed from the lint filter 40 are collected within the sump 52. This collection can occur as the circulated fluid 92 and the particulate 42 move around the inside surface 74 of the tub 20. This collection can also occur by decelerating the drum 14 to the third speed 172 (step 614). By decelerating the drum 14, this allows the wash fluid 50 and the particulate 42 to fall under the force of gravity toward the sump 52 of the tub 20. As described herein, the third speed 172 is slower than the second speed 164. The wash fluid 50 and the particulate 42 are drained from the sump 52 (step 616). This drain 56 occurs through the use of a fluid pump 94 that is attached to the sump 52. After the wash fluid and particulate 42 are drained from the sump 52, the second drying cycle 132 is activated (step 618). As described herein, the step of adding wash fluid 50 occurs at least during the step of distributing the articles 12 along the inner surface 152 of the surface of the drum 14. This step of adding wash fluid 50 can occur during the entire step of distributing the articles 12, or can occur during only a portion of this distribution step.

Referring now to FIGS. 1-12 and 14, having described various aspects of the device for cleaning a lint filter 40, a method 700 is disclosed for cleaning a lint filter 40 located within a tub 20 of a combination washing and drying appliance 10. This method 700 is operated during the performance of a drying phase 100 of a laundry cycle where articles 12 are located within a perforated drum 14 that rotates within the tub 20. This method 700 includes a step of sensing a blockage within the lint filter 40 (step 702). This sensing can occur through various sensors that can include, but are not limited to, airflow sensors, voltage sensors coupled with the motor for the blower 34, temperature sensors, optical sensors, and other similar sensors that can be utilized for monitoring an amount of particulate 42 or other blockage that is entrapped on the interior surface 44 of the lint filter 40. According to the method 700, step 704 includes initiating an interruption 140 to the drying phase 100 so that the filter cleaning phase 70 can be performed. A step 706 includes distributing the articles 12 along the inner surface 152 of the perforated drum 14 by rotating the perforated drum 14 at the first speed 156. Once the articles 12 are distributed into the balanced state 154, wash fluid 50 is added to the tub 20 (step 708). As described herein, this step of adding wash fluid 50 occurs by operating a valve 48 using impulse operations for providing very small amounts of wash fluid 50 that can be moved toward the sump 52 under surface adhesion. According the method 700, step 710 includes circulating the wash fluid 50 as circulated fluid 92 along the inside surface 74 of the tub 20 by rotating the drum 14 at the second speed 164 that is faster than the first speed 156. As described herein, the movement of the drum 14 at the second speed 164 utilizes the effective air ventilation 162 for moving the circulated fluid 92 along the inside surface 74 of the tub 20 and over the interior surface 44 of the lint filter 40 for separating particulate 42 from the lint filter 40 (step 712). Once the lint filter 40 is washed using the circulated fluid 92, the circulated fluid 92 and the particulate 42 are collected within a lower portion 54 of the tub 20 (step 714). This lower portion 54 of the tub 20 is typically characterized by the sump 52. Additionally, the drum 14 is decelerated to minimize the effect of air ventilation 162 such that the wash fluid 50 and particulate 42 can fall under the force of gravity toward the sump 52. As the wash fluid 50 and particulate 42 collect within this sump 52, step 716 includes draining the sump 52 to deliver the wash fluid 50 and particulate 42 to the external drain 56.

According to various aspects of the device, the adding step (step 708) typically occurs during at least a portion of the distributing step (step 706). Additionally, the draining step (step 716) typically occurs during at least a portion of the collecting step (step 714).

According to the various aspects of the device, this filter cleaning phase 70 can be operated during consecutive drying cycles. Where a washing cycle is utilized between two drying cycles, the washing cycle will necessarily result in fluid being distributed throughout the tub 20 and removing particulate 42 from the lint filter 40. In this instance where two drying phases 100 occur consecutively, no washing phase occurs such that particulate 42 collects on the lint filter 40. Additionally, because two drying phases 100 are being conducted consecutively, it is typical that the same load of articles 12 are being processed within an appliance 10. Accordingly, using the filter cleaning phase 70 described herein, the articles 12 being dried within the drum 14 do not need to be removed during performance of the filter cleaning phase 70. Additionally, because of the configuration of the rotating drum 14 and the speed at which the drum 14 rotates as well as the impulse activations of the valve 48 for distributing wash fluid 50, the wash fluid 50 is contained within the interstitial space 78 defined between the drum 14 and the tub 20. Accordingly, little if any wash fluid 50 is able to enter into the drum 14 for partially saturating the articles 12 contained therein. Accordingly, the drying level achieved by the first drying cycle 130 is not frustrated by the application of additional wash fluid 50 being added into the drum 14. Use of the filter cleaning phase 70 prevents infiltration of wash fluid 50 into the drum 14 such that little to no re-drying needs to occur.

According to various aspects of the device, use of the filter cleaning phase 70 is typically conducted within a combination washing and drying appliance 10. These appliances 10 can include a recirculating airflow path 38 that recirculates the same process air 36 within the cabinet 24 for the appliance 10. This filter cleaning phase 70 can also be used in combination washing and drying appliances 10 that utilize a vented system where process air 36 is vented to areas external of the appliance 10.

According to another aspect of the present disclosure, a combination washing and drying appliance includes a tub having a wall and positioned within an outer cabinet. The tub includes an air outlet through an upper portion of the wall. A drum rotationally operates within the tub. An air handling system is attached to the wall of the tub and that draws process air from inside the tub and through the air outlet to an airflow path. A lint filter is disposed within the air outlet and that filters particulate from the process air entering the airflow path. A fluid delivery system includes a valve that operates to deliver wash fluid into the inside of the tub. A sump is defined within a lower portion of the tub and below the drum. The sump includes a drain that moves wash fluid from the inside of the tub to an external outlet. During a filter cleaning phase of the appliance, the fluid delivery system delivers impulse amounts of the wash fluid to deliver the wash fluid to the sump and to maintain the wash fluid between an outer surface of the drum and an inside surface of the tub. The drum operates to direct the wash fluid in the sump around the drum and along the inside surface of the tub and over an interior surface of the lint filter to remove particulate from the lint filter. A fluid pump coupled with the sump directs the wash fluid and the particulate to the external outlet.

According to another aspect, the filter cleaning phase is configured to operate while articles being dried are within a processing space defined within a perforated wall of the drum.

According to yet another aspect, rotational operation of the drum during the filter cleaning phase maintains substantially all of the wash fluid outside of the drum and within an interstitial space defined between the outer surface of the drum and the inside surface of the tub.

According to another aspect of the present disclosure, the filter cleaning phase is initiated after a first drying cycle and before a second drying cycle. The second drying cycle is directly after the first drying cycle.

According to another aspect, the filter cleaning phase is performed during an interruption in a drying cycle. The interruption is initiated by a sensor that detects an amount of the particulate on the inside surface of the lint filter and the drying cycle is continued after the filter cleaning phase is completed.

According to yet another aspect, articles are present within the drum during the interruption and during the filter cleaning phase that is initiated during the interruption.

According to another aspect of the present disclosure, the filter cleaning phase includes a low speed balancing phase that distributes articles within the drum along an inner surface of the drum to define a balanced state of the articles.

According to another aspect of the present disclosure, during the low speed balancing phase, the valve operates intermittently to deliver impulse amounts of the wash fluid that travel through surface adhesion along the inside surface of the tub and to the sump.

According to another aspect, the filter cleaning phase includes a high speed cleaning phase characterized by the drum rotating at a high rate of speed that uses air ventilation within the interstitial space to direct the wash fluid along the inside surface of the tub and over the lint filter.

According to yet another aspect, the filter cleaning phase includes a draining phase characterized by the drum decelerating and using centrifugal force to direct the wash fluid toward the inside surface of the tub and further characterized by activation of the fluid pump to deliver the wash fluid and the particulate to the external outlet.

According to another aspect of the present disclosure, the drum includes a perforated wall that allows wash fluid from moving between a processing space within the drum and the interstitial space between the drum and the tub. During operation of the filter cleaning phase, the wash fluid is maintained within the interstitial space and outside of the rotating drum.

According to another aspect, a method for operating a combination washing and drying appliance includes completing a first drying cycle with articles present within a rotating drum. A second drying cycle is selected immediately after the first drying cycle. The articles are distributed along an inner surface of the rotating drum by rotating the rotating drum at a first speed. Wash fluid is added to a tub that surrounds the rotating drum by adding impulse amounts of wash fluid that travel along an inside surface of the tub by surface adhesion. The wash fluid is circulated as circulated fluid along the inside surface of the tub using air ventilation produced by the rotating drum rotating at a second speed that is faster than the first speed. Particulate is removed from a lint filter using the circulated fluid. The circulated fluid and the particulate are collected within the sump by decelerating the rotating drum to a third speed to allow wash fluid and the particulate to fall under force of gravity into the sump of the tub, the third speed being slower than the second speed. The wash fluid and the particulate are drained from the sump by activating a fluid pump attached to the sump. The second drying cycle is activated.

According to yet another aspect, the step of adding wash fluid happens during the step of distribution of the articles along the inside surface of the tub.

According to another aspect of the present disclosure, the step of decelerating the rotating drum results in a portion of the circulated fluid falling onto an outer surface of the rotating drum. Rotations of the rotating drum at the third speed results in the circulated fluid being shed from the outer surface of the rotating drum via centrifugal force.

According to another aspect, the circulated fluid is maintained outside of the rotating drum to prevent the circulated fluid from saturating the articles contained within the rotating drum.

According to yet another aspect, a method for cleaning a lint filter located within a tub of a combination washing and drying appliance during performance of a drying phase of a laundry cycle where articles are located within a perforated drum that rotates within the tub includes steps of sensing a blockage in the lint filter, initiating an interruption in the drying phase, distributing the articles along an inner surface of the perforated drum by rotating the perforated drum at a first speed, adding wash fluid to the tub, circulating the wash fluid as circulated fluid along an inside surface of the tub by rotating the perforated drum at a second speed that is faster than the first speed, washing the lint filter using the circulated fluid to remove particulate from a surface of the lint filter, collecting the circulated fluid and the particulate within a lower portion of the tub by decelerating the perforated drum to allow the circulated fluid and the particulate to fall according to force of gravity and draining a sump to deliver the wash fluid and particulate to an external drain.

According to another aspect of the present disclosure, the step of adding the wash fluid to the tub is accomplished using impulse activations of a fluid valve to deliver impulse amounts of the wash fluid along the inside surface of the tub using surface adhesion.

According to another aspect, the step of collecting the circulated fluid and the particulate includes rotating the perforated drum at a speed that sheds a portion of the circulated fluid and the particulate toward the inside surface of the tub using centrifugal force.

According to yet another aspect, the adding step occurs during the distributing step.

According to another aspect of the present disclosure, the draining step occurs during the collecting step.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A combination washing and drying appliance comprising:

a tub having a wall and positioned within an outer cabinet, the tub having an air outlet defined within an upper portion of the wall;

a drum that rotationally operates within the tub;

an air handling system attached to the wall of the tub and that draws process air from inside the tub and through the air outlet of the wall of the tub and to an airflow path;

a lint filter that is disposed within the air outlet and that filters particulate from the process air entering the airflow path;

a fluid delivery system having a valve attached to the tub and that operates to deliver wash fluid into the inside of the tub; and a sump defined within a lower portion of the tub and below the drum, the sump having a drain that moves wash fluid from the inside of the tub to an external outlet, wherein:

during a filter cleaning phase of the appliance, the valve of the fluid delivery system delivers impulse amounts of the wash fluid to deliver the wash fluid to the sump by traveling along an inside surface of the tub by surface adhesion to maintain the wash fluid between an outer surface of the drum and the inside surface of the tub;

the drum operates to direct the wash fluid in the sump around the drum and along the inside surface of the tub and over an interior surface of the lint filter to remove particulate from the lint filter;

a fluid pump coupled with the sump directs the wash fluid and the particulate to the external outlet.

2. The combination washing and drying appliance of claim 1, wherein the filter cleaning phase is configured to operate while articles being dried are within a processing space defined within a perforated wall of the drum.

3. The combination washing and drying appliance of claim 1, wherein rotational operation of the drum during the filter cleaning phase maintains substantially all of the wash fluid outside of the drum and within an interstitial space defined between the outer surface of the drum and the inside surface of the tub.

4. The combination washing and drying appliance of claim 1, wherein the filter cleaning phase is initiated after a first drying cycle and before a second drying cycle, wherein the second drying cycle is directly after the first drying cycle.

5. The combination washing and drying appliance of claim 1, wherein the filter cleaning phase is performed during an interruption in a drying cycle, wherein the interruption is initiated by a sensor that detects an amount of the particulate on the inside surface of the lint filter and wherein the drying cycle is continued after the filter cleaning phase is completed.

6. The combination washing and drying appliance of claim 5, wherein articles are present within the drum during the interruption and during the filter cleaning phase that is initiated during the interruption.

7. The combination washing and drying appliance of claim 1, wherein the filter cleaning phase includes a low speed balancing phase that distributes articles within the drum along an inner surface of the drum to define a balanced state of the articles.

8. The combination washing and drying appliance of claim 7, wherein during the low speed balancing phase, the valve operates intermittently to deliver the impulse amounts of the wash fluid that travel through surface adhesion along the inside surface of the tub and to the sump, wherein the valve is positioned within a lower position of the wall of the tub relative to the air outlet.

9. The combination washing and drying appliance of claim 3, wherein the filter cleaning phase includes a high speed cleaning phase characterized by the drum rotating at a high rate of speed that uses air ventilation within the interstitial space to direct the wash fluid from the sump and along the inside surface of the tub and over the lint filter.

10. The combination washing and drying appliance of claim 1, wherein the filter cleaning phase includes a draining phase characterized by the drum decelerating and using centrifugal force to direct the wash fluid toward the inside surface of the tub and further characterized by activation of the fluid pump to deliver the wash fluid and the particulate to the external outlet.

11. The combination washing and drying appliance of claim 1, wherein the drum includes a perforated wall that allows wash fluid from moving between a processing space within the drum and the interstitial space between the drum and the tub, and wherein during operation of the filter cleaning phase, the wash fluid is maintained within the interstitial space and outside of the rotating drum.

12. A method for operating a combination washing and drying appliance, the method comprising steps of:

completing a first drying cycle with articles present within a rotating drum;

selecting a second drying cycle immediately after the first drying cycle;

distributing the articles along an inner surface of the rotating drum by rotating the rotating drum at a first speed;

adding wash fluid to a tub that surrounds the rotating drum by adding impulse amounts of wash fluid that travel along an inside surface of the tub by surface adhesion to a sump;

circulating the wash fluid from the sump as circulated fluid along the inside surface of the tub using air ventilation produced by the rotating drum rotating at a second speed that is faster than the first speed;

removing particulate from a lint filter using the circulated fluid;

collecting the circulated fluid and the particulate within the sump by decelerating the rotating drum to a third speed to allow wash fluid and the particulate to fall under force of gravity into the sump of the tub, the third speed being slower than the second speed;

draining the wash fluid and the particulate from the sump by activating a fluid pump attached to the sump; and activating the second drying cycle.

13. The method of claim 12, wherein the step of adding wash fluid happens during the step of distribution of the articles along the inside surface of the tub.

14. The method of claim 12, wherein the step of decelerating the rotating drum results in a portion of the circulated fluid falling onto an outer surface of the rotating drum, and wherein rotations of the rotating drum at the third speed results in the circulated fluid being shed from the outer surface of the rotating drum via centrifugal force.

15. The method of claim 12, wherein the circulated fluid is maintained outside of the rotating drum to prevent the circulated fluid from saturating the articles contained within the rotating drum.

16. A method for cleaning a lint filter located within a tub of a combination washing and drying appliance during performance of a drying phase of a laundry cycle where articles are located within a perforated drum that rotates within the tub, the method comprising steps of:

sensing a blockage in the lint filter;

initiating an interruption in the drying phase;

distributing the articles along an inner surface of the perforated drum by rotating the perforated drum at a first speed;

adding wash fluid to the tub for delivery to a sump within a lower portion of the tub;

circulating the wash fluid from the sump as circulated fluid along an inside surface of a wall of the tub by rotating the perforated drum at a second speed that is faster than the first speed;

washing the lint filter using the circulated fluid to remove particulate from a surface of the lint filter;

collecting the circulated fluid and the particulate within the sump of the tub by decelerating the perforated drum to allow the circulated fluid and the particulate to fall according to force of gravity; and draining the sump to deliver the wash fluid and particulate to an external drain.

17. The method of claim 16, wherein the step of adding the wash fluid to the tub is accomplished using impulse activations of a fluid valve disposed within the wall of the tub to deliver impulse amounts of the wash fluid along the inside surface of the wall of the tub using surface adhesion.

18. The method of claim 16, wherein the step of collecting the circulated fluid and the particulate includes rotating the perforated drum at a speed that sheds a portion of the circulated fluid and the particulate toward the inside surface of the tub using centrifugal force.

19. The method of claim 16, wherein the adding step occurs during the distributing step.

20. The method of claim 16, wherein the draining step occurs during the collecting step.

* * * * *